US005791402A

United States Patent [19]

Dumetz

[11] Patent Number: 5,791,402

[45] Date of Patent: Aug. 11, 1998

[54] BRAZED RADIATOR FOR A VEHICLE HAVING AN ACCESSORY SUPPORT

[75] Inventor: Yvon Dumetz, Chatillon, France

[73] Assignee: Vako Thermique Moteur, Le Mesnil-Saint-Denis, France

[21] Appl. No.: 869,573

[22] Filed: Jun. 5, 1997

[30] Foreign Application Priority Data

Jun. 5, 1996 [FR] France ..... 96 06933

[51] Int. Cl.[6] ..... F28F 9/007

[52] U.S. Cl. ..... 165/67; 165/149

[58] Field of Search ..... 165/67, 149

[56] References Cited

U.S. PATENT DOCUMENTS

| | | | |
|---|---|---|---|
| 3,795,274 | 3/1974 | Fieni | 165/67 X |
| 4,367,793 | 1/1983 | MacIntosh . | |
| 4,938,284 | 7/1990 | Howells | 165/149 |
| 5,535,819 | 7/1996 | Matsuura | 165/149 |

FOREIGN PATENT DOCUMENTS

| | | | |
|---|---|---|---|
| 108 479 | 5/1984 | European Pat. Off. . | |
| 2 527 325 | 11/1983 | France | 165/149 |
| 288488 | 10/1992 | Japan | 165/149 |

*Primary Examiner*—Leonard R. Leo
*Attorney, Agent, or Firm*—Morgan & Finnegan, L.L.P.

[57] ABSTRACT

A brazed engine cooling radiator for a motor vehicle comprises a row of flat tubes arranged in a bundle alternately with cooling fins, with a structural member extending along one end of the bundle. A support member, for carrying an accessory, is in the form of a saddle which straddles the structural member. The back portion of the saddle has press formed tongues which co-operate with ribs of the structural member so as to guide the support member longitudinally. The side edges of the support member have teeth which are upset under the structural member so as to immobilise the latter. The teeth deform portions of the endmost cooling fin that lies between the base of the structural member and the adjacent tube. This support member is less costly to make and fit. It is fitted by seaming after the radiator has been brazed.

8 Claims, 3 Drawing Sheets

BRAZED RADIATOR FOR A VEHICLE HAVING AN ACCESSORY SUPPORT

FIELD OF THE INVENTION

This invention relates to heat exchangers, in particular cooling radiators for the propulsion engines of motor vehicles, the heat exchanger comprising a bundle of parallel tubes for the flow therein of a fluid to be cooled, the tubes being aligned in at least one row, together with at least one profiled structural member which extends in the same longitudinal direction as the tubes, and which is disposed at one end of the said row, the heat exchanger further including at least one support member which is fixed on the said structural member so as to receive an accessory in a predetermined position with respect to the heat exchanger.

The component to be positioned by means of the support member may for example be a nozzle or mouth, the purpose of which is to direct through the radiator the stream of air which is produced by a fan and which is caused to flow over the tubes of the heat exchanger so as to cool the fluid flowing within the tubes.

DISCUSSION OF THE INVENTION

The object of the invention is to provide a support member which is less expensive to make than hitherto, and which is easy to fix on the heat exchanger.

According to the invention, a heat exchanger, in particular a cooling radiator for the propulsion engine of a motor vehicle, the heat exchanger comprising a bundle of parallel tubes for the flow therein of a fluid to be cooled, the tubes being aligned in at least one row, together with at least one profiled structural member which extends in the same longitudinal direction as the tubes, and which is disposed at one end of the said row, the heat exchanger further including at least one support member which is fixed on the said structural member so as to receive an accessory in a predetermined position with respect to the heat exchanger, is characterised in that the support member comprises a sheet metal saddle having a back portion which is adapted to bear on the structural member on the opposite side of the latter from the tube bundle, together with two side portions which extend from the back portion substantially in the direction in which the tubes are aligned and on either side of the tube bundle and structural member, with press-formed portions of the back portion projecting towards the structural member and cooperating with the profile of the latter so as to guide the saddle with respect to the structural member in the said longitudinal direction, each said side portion having, on its edge opposed to the back portion, teeth which are bent back towards the other side portion so as to trap the side edges of the structural member, whereby to hold the back portion in engagement on the latter and to immobilise the support member in the longitudinal direction.

The structural member is preferably in the form of a metal plate bent longitudinally so as to form two ribs which are turned away from the tube bundle, and in that the back portion has at least two press-formed portions, the lengthwise dimension of which extends transversely to the longitudinal direction, and which are located in the space defined between the said ribs.

The structural member preferably further defines a substantially flat base, from which the said ribs project and which is engaged on the tube bundle.

The press-formed portions are preferably in the form of tongues which are partially pressed out in the back portion.

The bundle of tubes preferably includes thin fin members in thermal contact with the tubes, the fin members having portions which are situated in two opposed main faces of the heat exchanger parallel to the longitudinal direction and to the direction of alignment, with the said teeth penetrating into the said main faces and deforming the said portions of the adjacent fin member.

Preferably, the support member includes a nut element for fastening the said accessory, the nut element being integral with the saddle. The nut element then preferably consists of a collar portion formed on a lug which extends the back portion laterally.

The heat exchanger is preferably assembled by brazing, the support member being fastened by seaming on to the brazed assembly.

Further features and advantages of the invention will appear more clearly on the reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 1:
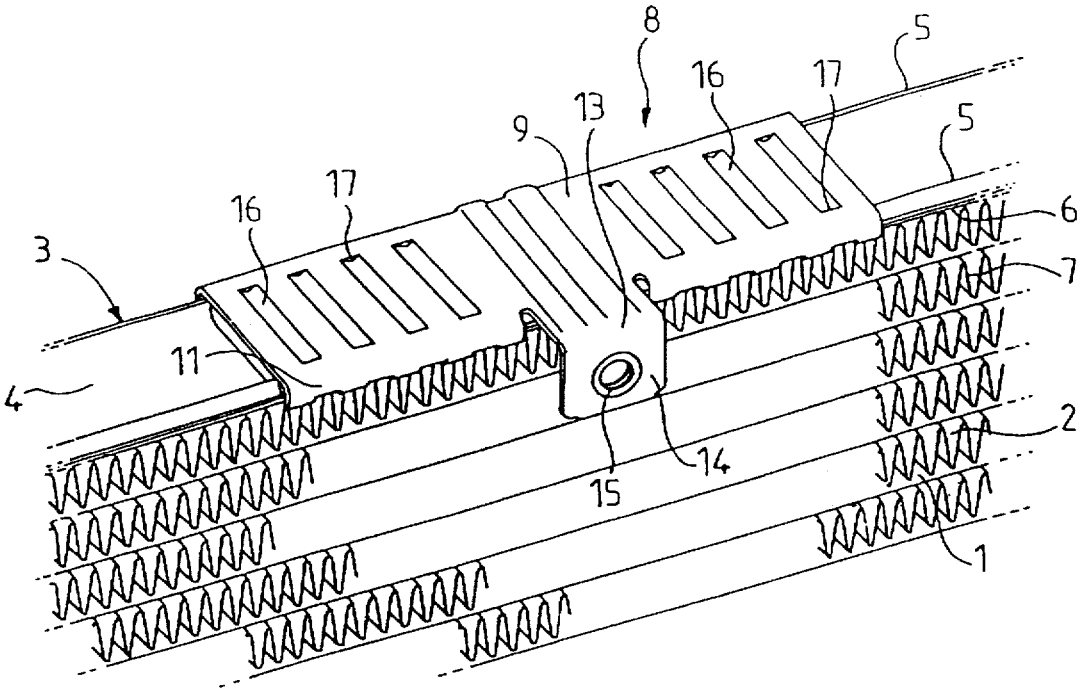
FIGS. 1 to 4 are partial perspective views of a cooling radiator in accordance with the invention, seen from four different angles.
Figure 2:
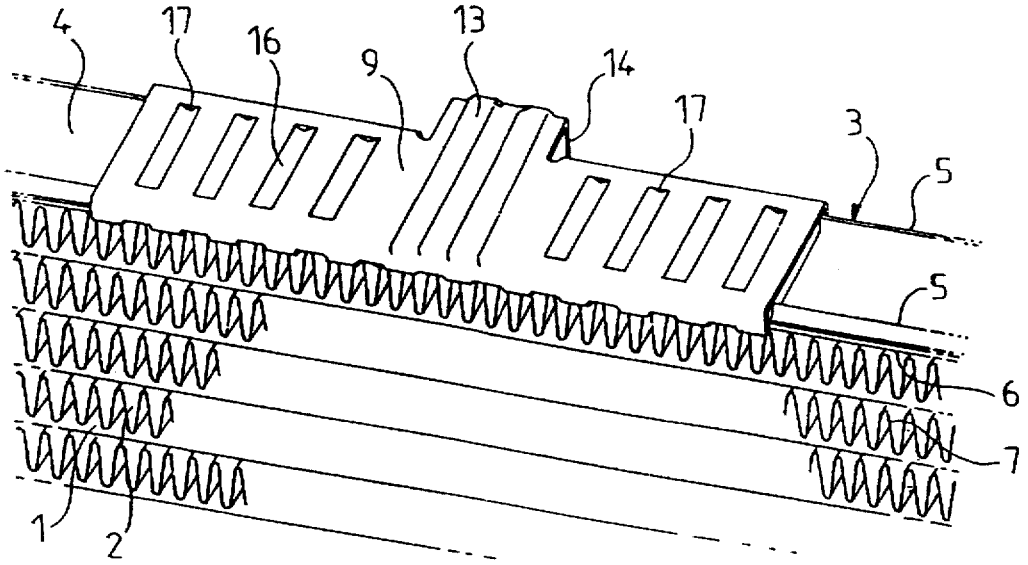
Figure 3:
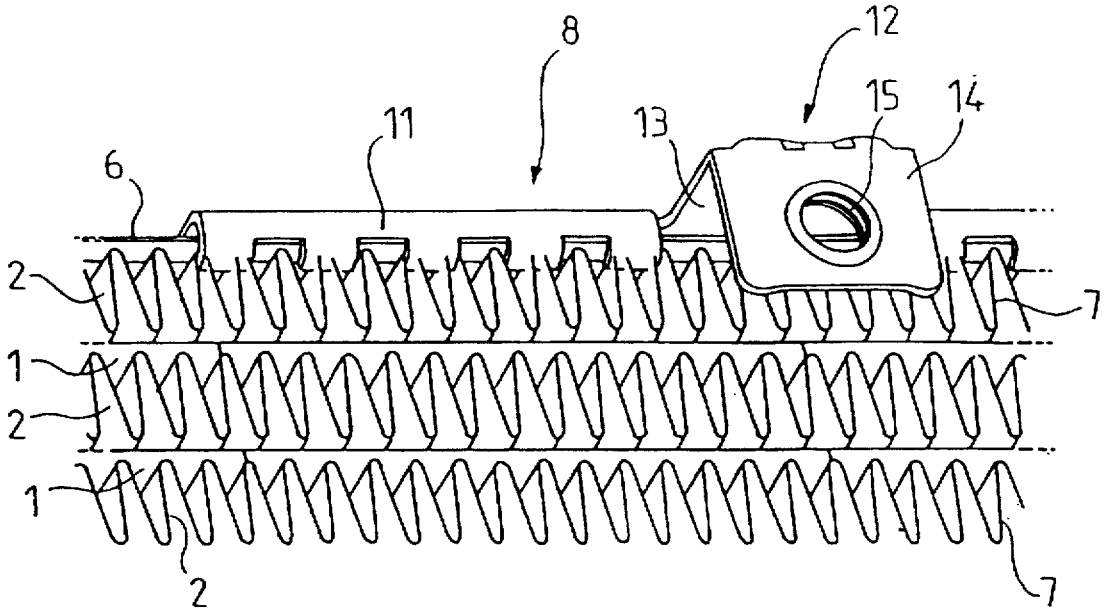
Figure 4:
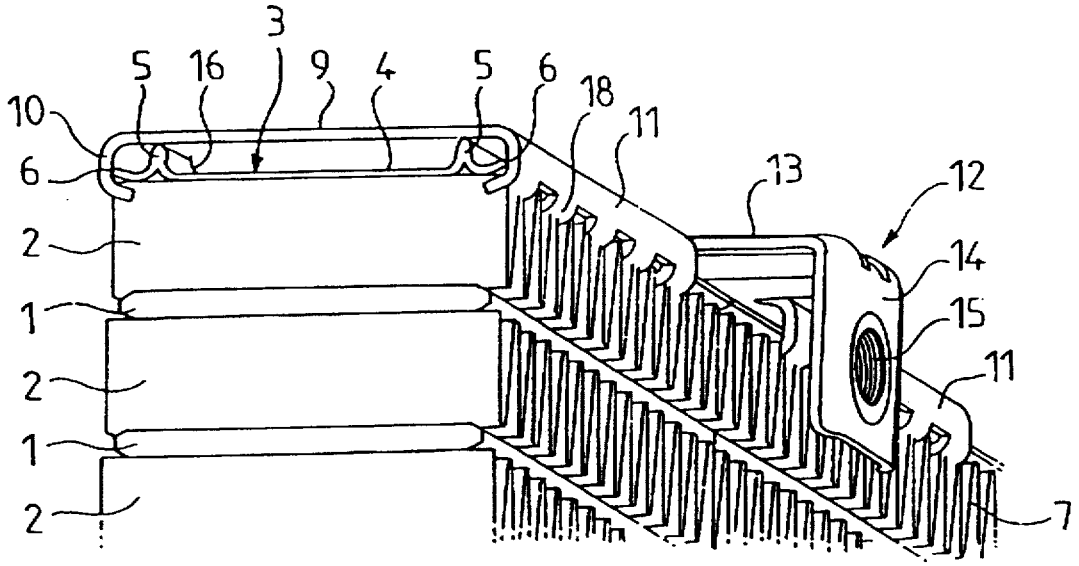

The radiator illustrated in the drawings is a cooling radiator for cooling a heat transfer fluid which recovers the heat given off by the heat engine of a motor vehicle. The radiator comprises a row of tubes 1 for flow of this fluid. The tubes 1 extend longitudinally in a common horizontal direction, and are aligned with each other in the vertical direction. They have a flattened transverse cross-section, the length of which is oriented horizontally, while its thickness is oriented vertically.

The tubes 1 are held spaced apart from each other by cooling fins or inserts 2 in the form of strips of corrugated sheet metal formed with sinusoidal corrugations. In each insert 2, the summits of the corrugations make alternate contact with two adjacent tubes in the row. The tube situated at the top end of the row is held, by means of an endmost insert 2 which is similar to those described above, spaced apart from a profiled structural member 3 which is oriented lengthwise parallel to the longitudinal direction of the tubes. In the remainder of this description and in the Claims, this direction will simply be referred to as the longitudinal direction.

The profiled structural member 3 consists of a strip of sheet metal about 0.5 mm thick, which is bent along horizontal lines so as to form a substantially flat base 4 which bears on the summits of the corrugations of the adjacent insert 2, together with two longitudinal ribs 5 which project from the sides of the base 4 in a direction away from the adjacent insert 2 and the tubes 1. The two ribs 5 lie close to the two respective side edges, or marginal regions, 6 of the member 3. These side edges lie; respectively, in the same two vertical planes as the opposed portions 7 of the adjacent insert 2. These two planes, which are parallel to the longitudinal direction and to the direction in which the tubes are aligned, define two main faces of the radiator.

The radiator typically has, in the well known way, two fluid headers, into which the two ends of each tube 1 are open, and may also include a second structural member similar to the member 3, this second structural member being fitted at the lower end of the bundle that consists of the tubes 1 and inserts 2. The tubes 1, the inserts 2, the structural member 3 and, where applicable, the two fluid headers and lower structural member, are secured together by brazing so as to constitute a rigid unit.

A support member 8 is mounted on, and seamed to, this rigid unit. This support member 8 consists of a single component, which is a sheet metal pressing, press-formed and bent. The support member 8, which extends in the longitudinal direction, comprises a substantially flat back portion 9 which bears on the free edges of the two ribs 5, together with two longitudinal side portions 10 and 11. The side portions 10 and 11 are joined to the back portion 9 and are bent back substantially at right angles towards the tube bundle, so as to face towards the two main faces of the tube bundle. The side portion 10 extends over the whole length of the support member 8, while the side portion 11 is in two parts, each of which is adjacent to a respective one of the two ends of the support member. Between these two parts of the side portion 11 the base 9 is joined to an L-shaped lug 12, having a branch 13 which is extended laterally, substantially in its own plane, while the other branch 14 is bent back at right angles with respect to the first branch 13, so as to lie facing the corresponding main face of the unit. A central zone of the branch 14 is upset towards the brazed unit so as to form a threaded collar portion 15.

Figure 5:
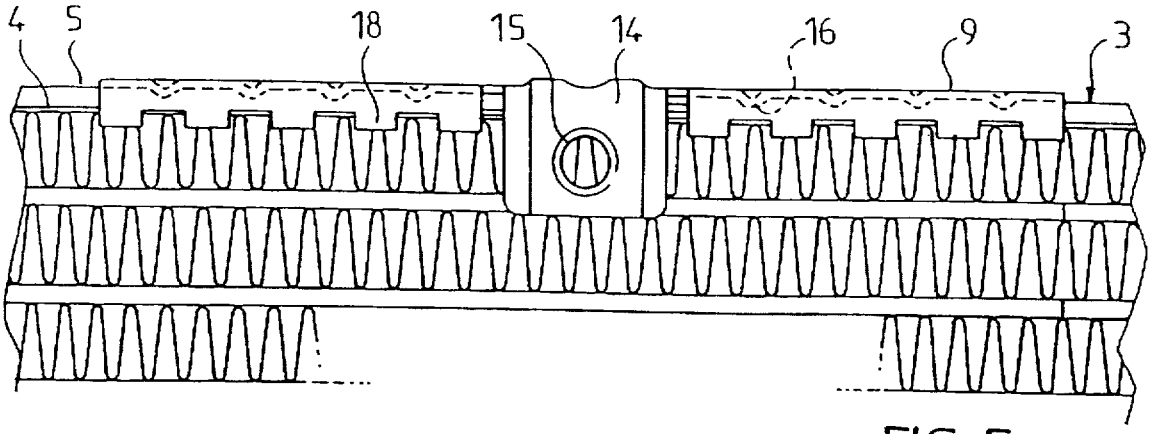
FIG. 5 is a partial view of the radiator in elevation.
Figure 6:
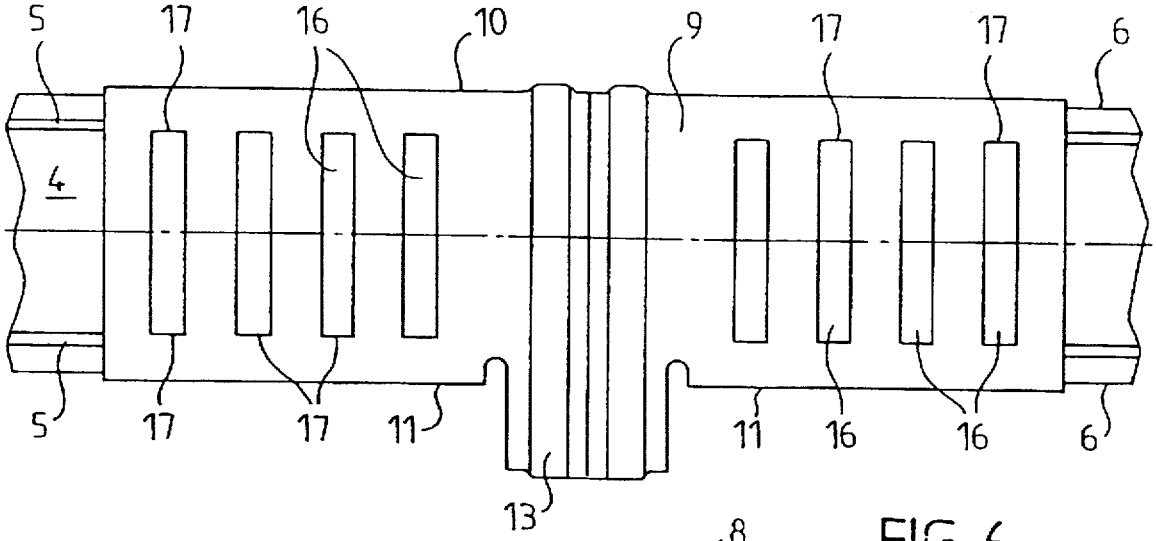
FIG. 6 is a partial top view.

A number of press-formed tongues 16 are formed in each of the two regions of the back portions 8 that are adjacent to the two parts of the side portion 11. Each of these tongues 16 extends across the back portion 9, and the tongues 16 are aligned with each other in the longitudinal direction. Each tongue 16 is bounded at its two ends by slots 17 which are formed by punching through the thickness of the back portion, and which are oriented in the longitudinal direction. This enables the tongues to be formed by stamping the support member 8 locally towards the base 4 of the member 3, in an arcuate profile as can be seen in FIG. 5. The length of the tongues 16 corresponds to the space between the two ribs 5, so that the two ends of each tongue can come substantially into engagement on the internal flanks of the ribs, thus enabling the support member 8 to be guided longitudinally with respect to the structural member 3.

Figure 7:
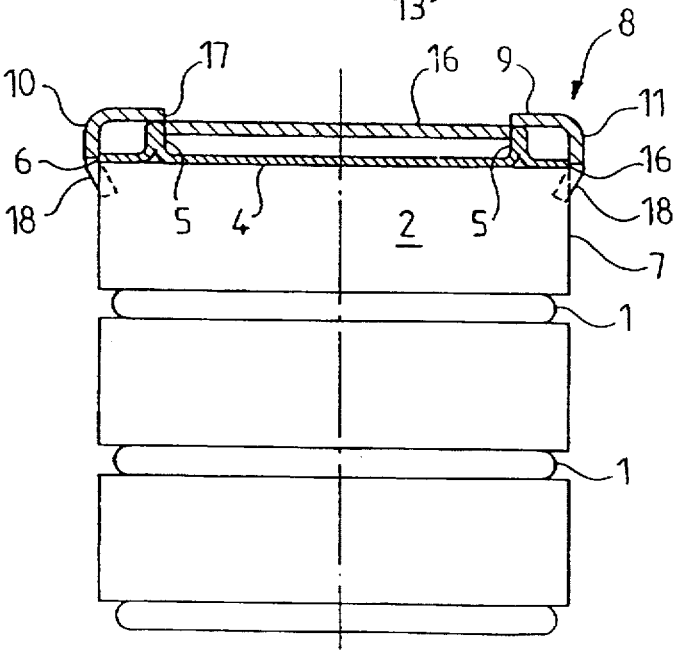
FIG. 7 is a partial view of the radiator in transverse cross-section.

The free edges of the side portions 10 and 11 are crenellated so as to form teeth 18 which, when the support member is suitably positioned with respect to the bundle of tubes and with respect to the structural member 3, are turned back under the edges 6 of the member 3, towards the other side portion in each case. These teeth thus penetrate into the portions 7 of the adjacent insert 2, so that the latter is deformed by the teeth. Thus, the co-operation of the tongues 16 with the ribs 5 immobilises the support member 8 with respect to the brazed unit in the lateral direction, while the upsetting of the teeth 18 completes this immobilisation in the longitudinal direction and in the direction in which the tubes 1 are aligned. As can be seen in FIG. 7, the bent-back teeth 18 can make direct contact with the edges 6 of the structural member 3, so as to trap the latter between the teeth and the back portion 9, with the deformation of the insert portions 7 also providing immobilisation in the longitudinal direction.

An accessory such as a nozzle or mouthpiece for guiding a stream of air, may be fixed on the support member 8 by, means of a screw which is screwed into the threaded collar portion 15. Depending on the dimensions and weight of the accessory, two support members such as the member 8, or more, may be disposed along the structural member 3. Similar supports can of course also be fitted on the other structural member fitted at the lower end of the tube bundle.

The support member according to the invention, for example the one described above, is easy and inexpensive to make and fit. It may be arranged at the required position along the structural member without the latter needing to be modified. In addition, it is fitted after the radiator has been brazed, so that the brazing equipment no longer has to be modified in order to take the presence of the support member into account.

What is claimed is:

1. A heat exchanger comprising a bundle of parallel tubes arranged in at least one row and defining a longitudinal direction; at least one profiled structural member extending in the longitudinal direction and disposed at one end of the row; and at least one support member fixed on the structural member for receiving an accessory in a predetermined position with respect to the heat exchanger, wherein the support member comprises a sheet metal saddle having a back portion engaging on the structural member on a side opposite to the tube bundle, the saddle further including two side portions extending from the back portion substantially in the direction of alignment of the tubes on opposed sides of the bundle and structural member, the back portion being press-formed with portions projecting towards the structural member and co-operating with the profile of the structural member to guide the saddle with respect to the structural member in the longitudinal direction, each said side portion having an edge opposed to the back portion, the teeth of each said side portion being bent back towards the other side portion, wherein marginal regions of the structural member are trapped and hold the back portion of the saddle against the structural member while immobilising the support member in the longitudinal direction.

2. A heat exchanger according to claim 1, wherein the structural member is a sheet metal component bent longitudinally to define two ribs projecting in a direction away from the tube bundle, the back portion of the saddle having at least two press-formed portions each defining a lengthwise direction thereof transverse to the longitudinal direction, the structural member defining a space between said ribs, the press-formed portions of the back portion being located in the space.

3. A heat exchanger according to claim 2, wherein the structural member further includes a substantially flat base which bears on the tube bundle, with said ribs projecting from the base.

4. A heat exchanger according to claim 1, wherein the press-formed portion comprise tongues formed by partial pressing-out in the back portion.

5. A heat exchanger according to claim 1, wherein the bundle of tubes further includes thin fin members in heat exchange contact with the tubes, each said fin portion having portions situated in two opposed main faces of the heat exchanger parallel to the longitudinal direction and parallel to the direction of alignment, the teeth penetrating into the main faces and deforming the portions of the fin members.

6. A heat exchanger according to claim 1, wherein the support member includes a nut element for fastening said accessory, the nut element being integral with the saddle.

7. A heat exchanger according to claim 6, wherein the support member further includes a lug extending the back portion laterally, the nut element comprising a collar portion formed on the lug.

8. A heat exchanger according to claim 1, assembled by brazing, the support member being seamed onto the brazed assembly.

* * * * *

UNITED STATES PATENT AND TRADEMARK OFFICE

CERTIFICATE OF CORRECTION

PATENT NO. : 5,791,402
DATED :August 11, 1998
INVENTOR(S) :Dumetz

It is certified that error appears in the above-identified patent and that said Letters Patent is hereby corrected as shown below:

On the cover page, in item [73], replace "Vako" with --Valeo--

Signed and Sealed this

Twenty-ninth Day of December, 1998

*Attest:*

Bruce Lehman

BRUCE LEHMAN

*Attesting Officer*

*Commissioner of Patents and Trademarks*